United States Patent [19]

Nakajima

[11] Patent Number: 5,056,990

[45] Date of Patent: Oct. 15, 1991

[54] VARIABLE CAPACITY VANE COMPRESSOR

[75] Inventor: Nobuyuki Nakajima, Konan, Japan

[73] Assignee: Diesel Kiki Co., Ltd., Tokyo, Japan

[21] Appl. No.: 428,828

[22] Filed: Oct. 30, 1989

[30] Foreign Application Priority Data

Nov. 4, 1988 [JP] Japan ..... 63-144192[U]

[51] Int. Cl.[5] ..... F04B 49/00; F04B 49/02

[52] U.S. Cl. ..... 417/295; 417/310

[58] Field of Search ..... 417/295, 310

[56] References Cited

U.S. PATENT DOCUMENTS

| | | | |
|---|---|---|---|
| 2,878,753 | 3/1959 | Adams et al. | 417/310 |
| 4,441,863 | 4/1984 | Hotta et al. | 417/310 |
| 4,715,792 | 12/1987 | Nishizawa et al. | 417/295 |
| 4,776,770 | 10/1988 | Nakatima et al. | 417/295 |

*Primary Examiner*—Richard A. Bertsch
*Assistant Examiner*—John A. Savio, III
*Attorney, Agent, or Firm*—Charles S. McGuire

[57] ABSTRACT

A variable capacity vane compressor has a control element rotatable in response to the difference between suction pressure and control pressure for varying the compression starting timing and hence the capacity. A communication passage extends between the suction chamber and a high pressure chamber in which the control pressure is created. A spool valve opens and closes the communicating passage. An electromagnetic actuator generates an electromagnetic force to cause the spool valve to open the communication passage when energized. A control unit is arranged outside of the compressor and supplies the actuator with an external control signal for energizing the actuator.

8 Claims, 5 Drawing Sheets

VARIABLE CAPACITY VANE COMPRESSOR

BACKGROUND OF THE INVENTION

This invention relates to a variable capacity vane compressor which has variable compression starting timing to thereby control the delivery quantity or capacity of the compressor.

A variable capacity vane compressor for use in air conditioners for automotive vehicles has been proposed by Japanese Provisional Patent Publication (Kokai) No. 63-16186 assigned to the assignee of the present application, which has a control element having a high pressure chamber defined therein for creating control pressure from discharge pressure, the control element being rotatable in opposite directions in response to the difference between the control pressure and suction pressure from a suction chamber to assume a partial capacity position and a full capacity position for varying the compression starting timing and hence the capacity of the compressor, a control valve device arranged to establish communication between the high pressure chamber and the suction chamber for permitting the control pressure to leak from the former into the latter, the control valve device having a bellows expanding and contracting in response to change in the suction pressure in accordance with a thermal load, and a spool valve having a spool as a valve body responsive to the bellows for displacement between a valve opening position and a valve closing position, and wherein the valve control device controls the control pressure to control the angular position of the control element so as to bring the suction pressure to a predetermined value. In addition, a compressor having a ball valve in place of the spool valve has also been proposed by the same assignee.

The proposed compressors are adapted to control the capacity thereof so as to bring the suction pressure to the predetermined value (Internal Control). Such variable capacity compressors may be further controlled in capacity by an external control signal by means of electronic control means. To control the capacity by the external control signal, an electromagnetic valve may be used in place of the above-mentioned control valve device using bellows to vary the angular position of the control element.

However, in the case where the control valve device is formed of a bellows and a ball valve, if the bellows is replaced by an electromagnetic valve, a large electromagnetic force has to be applied upon the ball valve to open the valve to counteract the control pressure which is high pressure and usually acts upon the ball valve in a direction closing the valve. However, it is impossible to mount in the compressor an electromagnetic valve which is so large in capacity and hence size as to overcome the valve opening pressure of the ball valve.

On the other hand, in the case where the control valve device is formed of a bellows and a spool valve, if the bellows is replaced by an electromagnetic valve, the spool valve can be arranged such that the spool thereof has opposite end faces both acted upon by the suction pressure and is thus balanced in pressure. Therefore, the spool can be positively displaced in a valve opening direction even by a small force applied by the electromagnetic valve.

SUMMARY OF THE INVENTION

It is an object of the invention to provide a variable capacity vane compressor which is capable of electronically controlling the capacity thereof based on an external control signal, but which can be compact in size.

It is a further object of the invention to provide a variable capacity vane compressor of the external control signal-based control type, which is capable of controlling the capacity in a fine manner with high responsiveness.

To attain the above object, the present invention provides a variable capacity vane compressor having a suction chamber, at least one low pressure chamber disposed to be supplied with suction pressure from the suction chamber, at least one high pressure chamber for creating therein control pressure having a value higher than the suction pressure, a control element arranged for rotation in response to a difference between the suction pressure within the low pressure chamber and the control pressure within the high pressure chamber for varying compression starting timing in the compressor and hence capacity of the compressor, communication passage means extending between the high pressure chamber and the suction chamber, and control valve means for opening and closing the communication passage means for varying the control pressure.

The present invention is characterised by the improvement wherein the control valve means comprises:

a spool valve displaceable between a valve opening position for opening the communication passage means and a valve closing position for closing the communicating passage means;

an electromagnetic actuator disposed to generate an electromagnetic force to cause the spool valve to assume the valve opening position when energized; and control means arranged outside of the compressor for supplying the actuator with an external control signal for energizing same.

Preferably, the spool valve may comprise a valve casing having inlet port means and outlet port means both formed therein and communicating with the high pressure chamber and the suction chamber, respectively, a spool slidably received within the valve casing for displacement between the valve opening position and the valve closing position, the spool having formed therein inlet passage means alignable with the inlet port means when it assumes the valve opening position, outlet passage means always aligned with the outlet port means irrespective of a position assumed by the spool, and internal passage means communicating between the inlet passage means and the outlet passage means, and spring means urging the spool toward the valve closing position.

More preferably, the inlet port means of the valve casing and the inlet passage means of the spool may be arranged such that they are out of alignment with each other by a slight amount when the spool is in the valve closing position.

The internal passage means may axially extend through the spool and opens in opposite end faces thereof, whereby the opposite end faces of the spool are acted upon by the suction pressure supplied from the suction chamber through the outlet port means, the outlet passage means, and the internal passage means.

The inlet port means of the valve casing may comprise a plurality of radial ports circumferentially arranged, the inlet passage means of the spool comprising a plurality of radial passages circumferentially arranged at circumferential locations corresponding respectively to the radial ports.

The communication passage means may have a valve-receiving bore, the valve casing being fitted in the valve-receiving bore in a manner such that an annular space is defined between an outer peripheral surface of the valve casing and the valve-receiving bore, the inlet port means of the valve casing opening into the annular space.

The electromagnetic actuator may comprise a core formed of a magnetic material and having an axial projection formed integrally therewith, a solenoid mounted on the axial projection of the core for receiving the external control signal, and a cover covering the solenoid, the cover having a communication hole formed therethrough and communicating between the suction chamber and an outer peripheral surface of the solenoid, whereby refrigerant is supplied from the suction chamber through the communication hole to the outer peripheral surface of the solenoid.

The solenoid may have a through hole formed therein, into which the axial projection of the core is inserted, one end of the spool being slidably fitted into the through hole in facing relation to the axial projection, the spring means comprising a torsion coiled spring interposed between the axial projection and the one end of the spool and urging the spool toward the valve closing position.

The control signal may be an ON-OFF signal, the spool valve being disposed to open and close the communication passage means at a rate corresponding to a pulse duty factor of the ON-OFF signal for varying the control pressure in accordance with the pulse duty factor.

The above and other objects, features and advantages of the invention will become more apparent from the ensuing detailed description taken in conjunction with the accompanying drawings.

DETAILED DESCRIPTION

The invention will now be described in detail with reference to the drawings showing an embodiment thereof.

Figure 1:
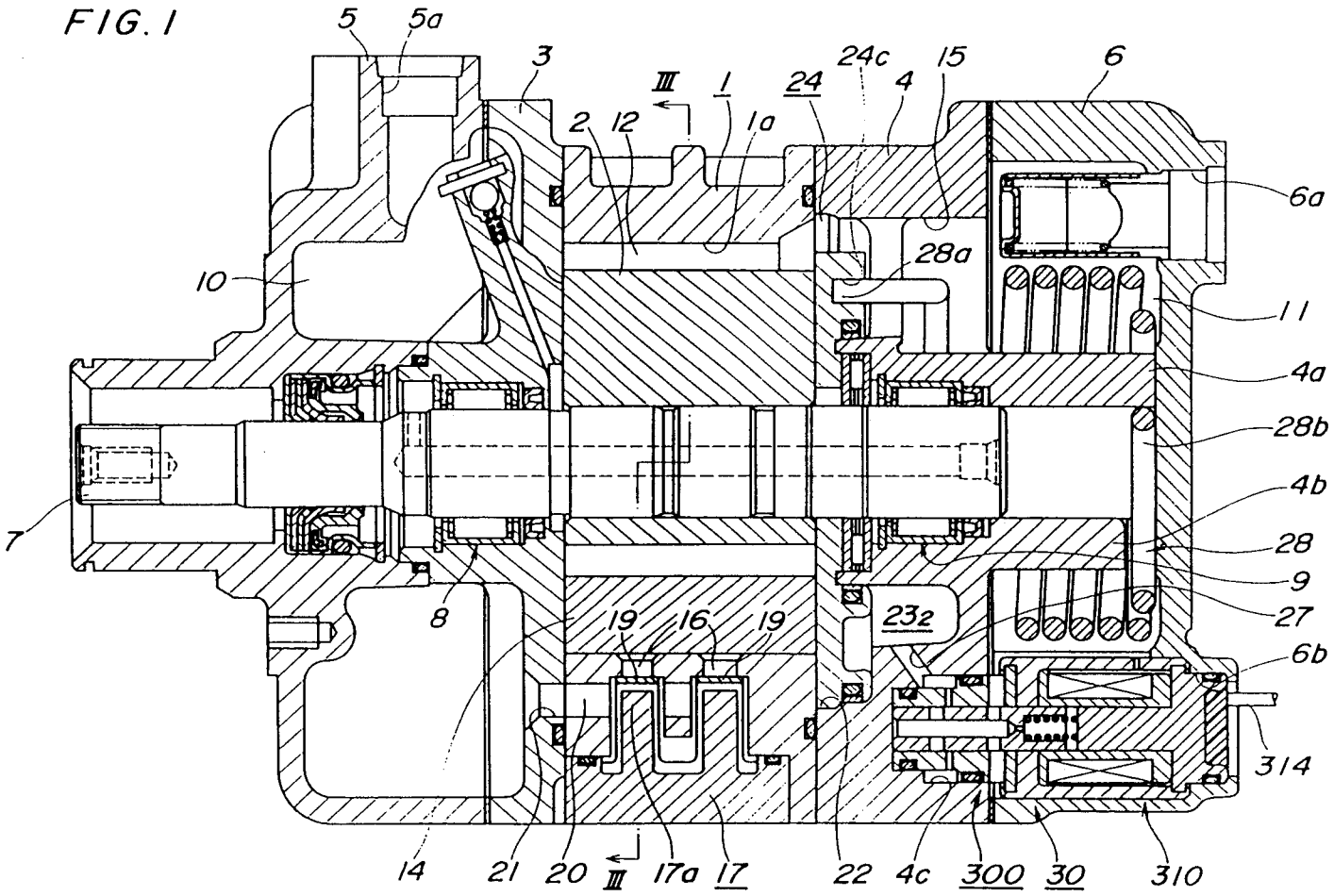
FIG. 1 is a longitudinal sectional view of a variable capacity vane compressor according to one embodiment of the invention.
Figure 3:
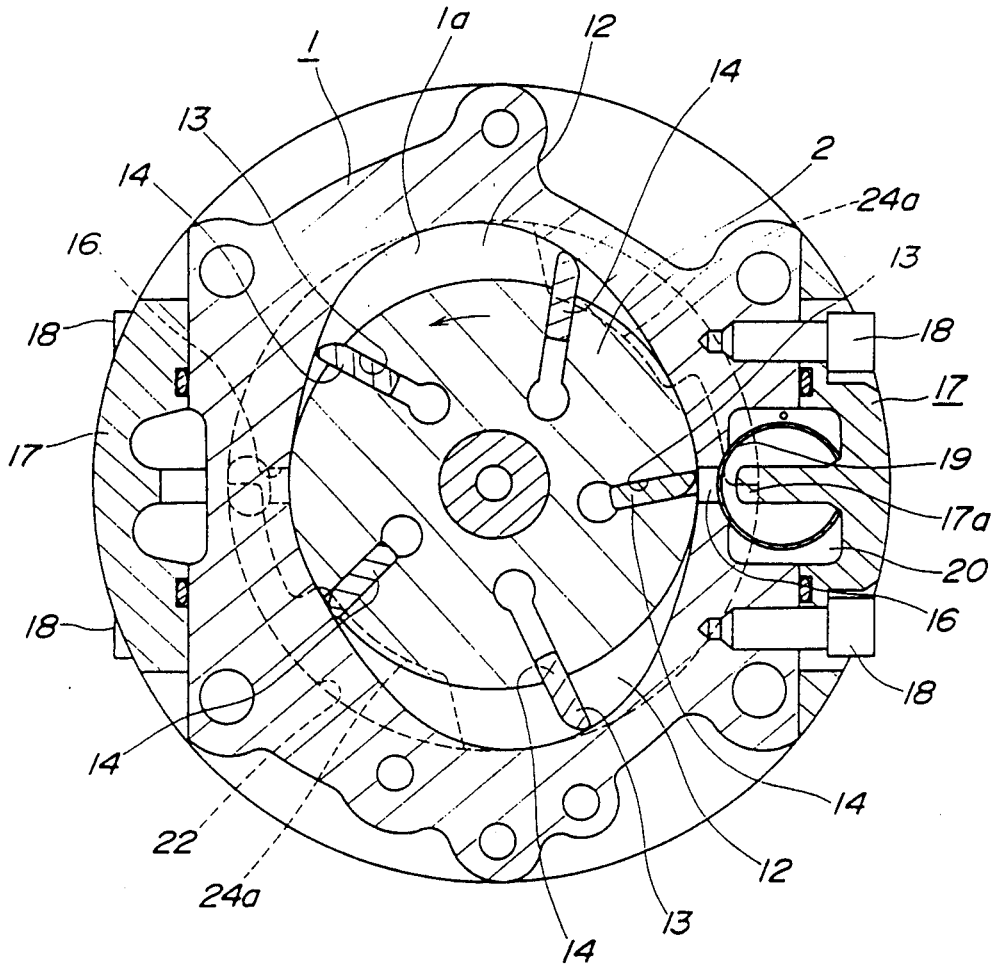
FIG. 3 is a transverse sectional view taken along line III—III in FIG. 1, wherein a control element is in a full capacity position.

Referring first to FIGS. 1 and 3, there is illustrated a variable capacity vane compressor. As shown in the figures, the compressor has a cylinder formed by a cam ring 1 having an inner peripheral camming surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As best shown in FIG. 3, a pair of compression spaces 12, 12 are defined at diametrically opposite locations between the inner pheripheral camming surface 1*a* of the cam ring 1, an outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane 14 is radially slidably fitted.

A pair of refrigerant inlet ports 15, 15 are formed in the rear side block 4 at diametrically opposite locations, only one of which is shown in FIG. 1. These refrigerant inlet ports 15, 15 are located at such circumferentianl locations that they become closed when a compression chamber defined between successive two vanes 14 assumes the maximum volume. These refrigerant inlet ports 15, 15 axially extend through the rear side block 4 and through which the suction chamber 11 is communicated with the compression spaces 12 and 12.

A pair of refrigerant outlet ports 16, 16 are formed through opposite lateral side walls of the cam ring 1 at diametrically opposite locations, as shown in FIGS. 1 and 3, only one of which is shown in FIG. 1. The opposite lateral side walls of the cam ring 1 are provided with two discharge valve covers 17, 17, each formed integrally with a valve stopper 17*a*, and fixed to the cam ring 1 by fixing bolts 18. Discharge valves 19, 19 are mounted between the respective lateral side walls of the cam ring 1 and the valve covers 17, 17 in such a manner that they are supported by the valve covers 17, 17. A pair of communication passages 20, 20 are defined between the respective lateral side walls of the cam ring 1 and the valve covers 17, 17, which communicate with the respective refrigerant outlet ports 16 when the associated discharge valves 19 are open. A pair of communication passages 21, 21 are formed in the front side block 3, which communicate with the respective communication passages 20.

With such arrangement, when the discharge valves 19 open to thereby open the refrigerant outlet ports 16, a compressed refrigerant gas in the associated compression space 12 is discharged through the refrigerant discharge outlet ports 16, the communication passages 20, 21 and the discharge pressure chamber 10, in the mentioned order, to be discharged into a refrigerating circuit, not shown, through the discharge port 5*a*.

Figure 5:
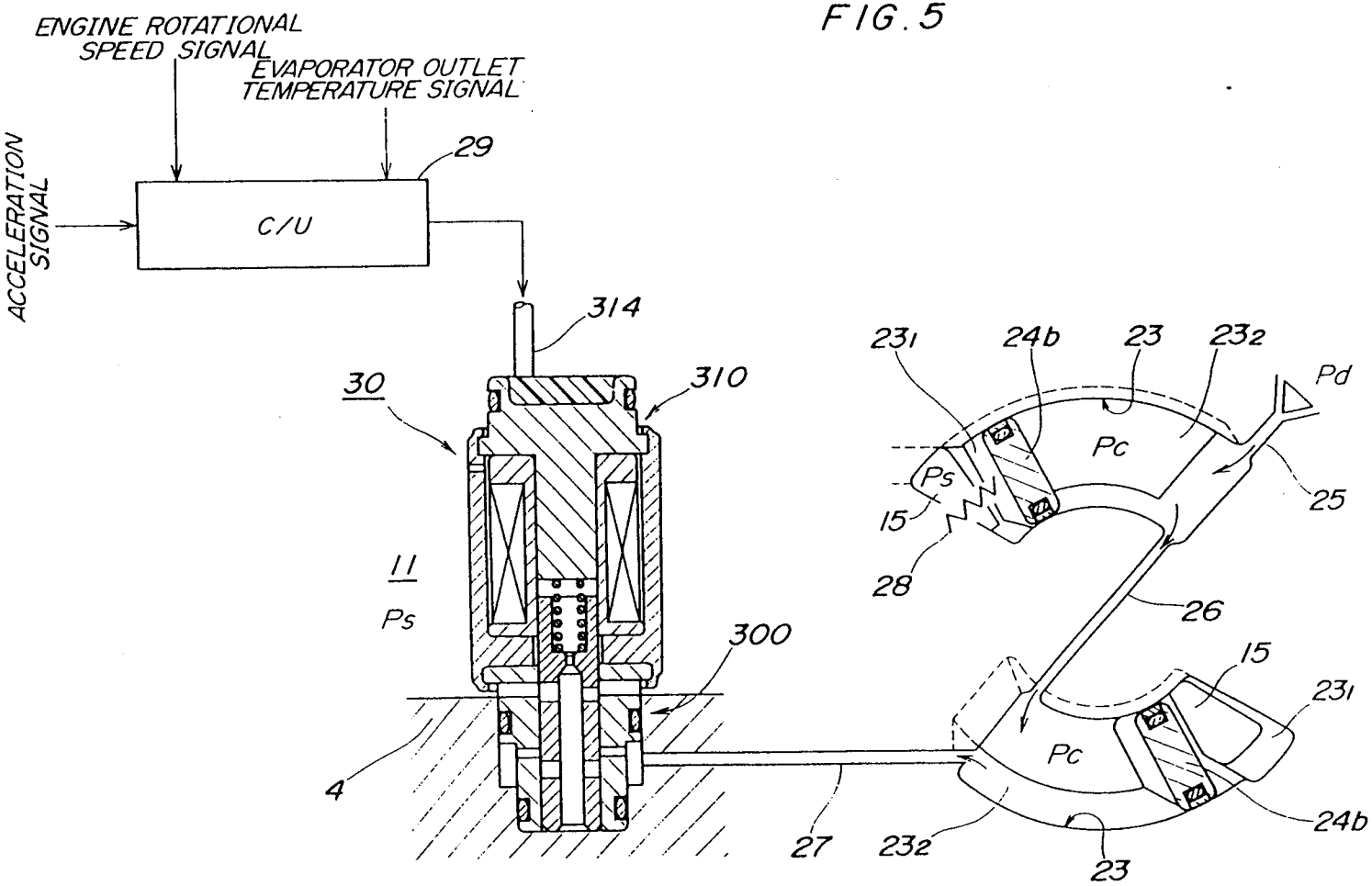
FIG. 5 is a schematic diagram useful in explaining the relationship between the electromagnetic spool valve, high pressure chambers, and a control unit.

As shown in FIG. 1, the rear side block 4 has an end face facing the rotor 2, in which is formed an annular recess 22. As shown in FIGS. 1 and 5, a pair of pressure working chambers 23, 23 are formed in a bottom of the annular recess 22 at diametrically opposite locations.

A control element 24, which is in the form of an annulus, is received in the annular recess 22 for rotation about its own axis in opposite circumferential directions. The control element 24 has its outer peripheral edge formed with two diametrically opposite arcuate cut-outs 24*a*, 24*a* as shown in FIG. 3, and its one side surface formed integrally with a pair of diametrically opposite pressure-receiving protuberances 24*b*, 24*b* as shown in FIG. 5, which are axially projected therefrom and act as pressure-receiving elements. The interior of each of the pressure working chambers 23, 23 is divided into a low pressure chamber $23_1$ and a high pressure chamber $23_2$ by the associated pressure-receiving protuberance 29. Each low pressure chamber $23_1$, $23_1$ communicates with the suction chamber 11 through the corresponding refrigerant inlet port 15 and is supplied with refrigerant gas having suction pressure or low pressure Ps. On the other hand, one of the high pressure chambers $23_2$, $23_2$ communicates with the communication passage 20 via a restriction passage 25 formed in the rear side block 4, and also communicates with the other high pressure chamber $23_2$ by way of a communication passage 26 formed in the rear side block 4, so that the both high pressure chamber $23_2$, $23_2$ are supplied with the discharge pressure Pd to create control pressure Pc therefrom. The other high pressure chamber $23_2$ is communicatable with the suction chamber 11 via a passage 27 formed in the rear side block 4 and a control valve device 30 arranged across the passage 27, as shown in FIGS. 1 and 5.

The control element 24 is urged in the clockwise direction as viewed in FIG. 5 by a torsion coiled spring 28, which, as shown in FIG. 1, is fitted around a hub 4*a* of the rear side block 4 axially extending through the suction chamber 11 with its one end 28*a* engaged in an engaging hole 24*c* formed in one side surface of the control element 24 remote from the rotor 2 and its other end 28*b* engaged in a retaining groove 4*b* formed in an end face of the hub 4*a*. Thus, the control element 24 is rotatable in opposite directions in response to the difference between the sum of the suction pressure Ps within the low pressure chambers $23_1$, $23_1$ and the urging force of the torsion coiled spring 28, and the control pressure Pc within the high pressure chambers $23_2$, $23_2$, between two extreme positions, i.e., a full capacity position shown in FIG. 3 for obtaining the maximum delivery quantity or capacity of the compressor, and a partial capacity position shown in FIG. 4 for obtaining the minimum delivery quantity or capacity.

Figure 2:
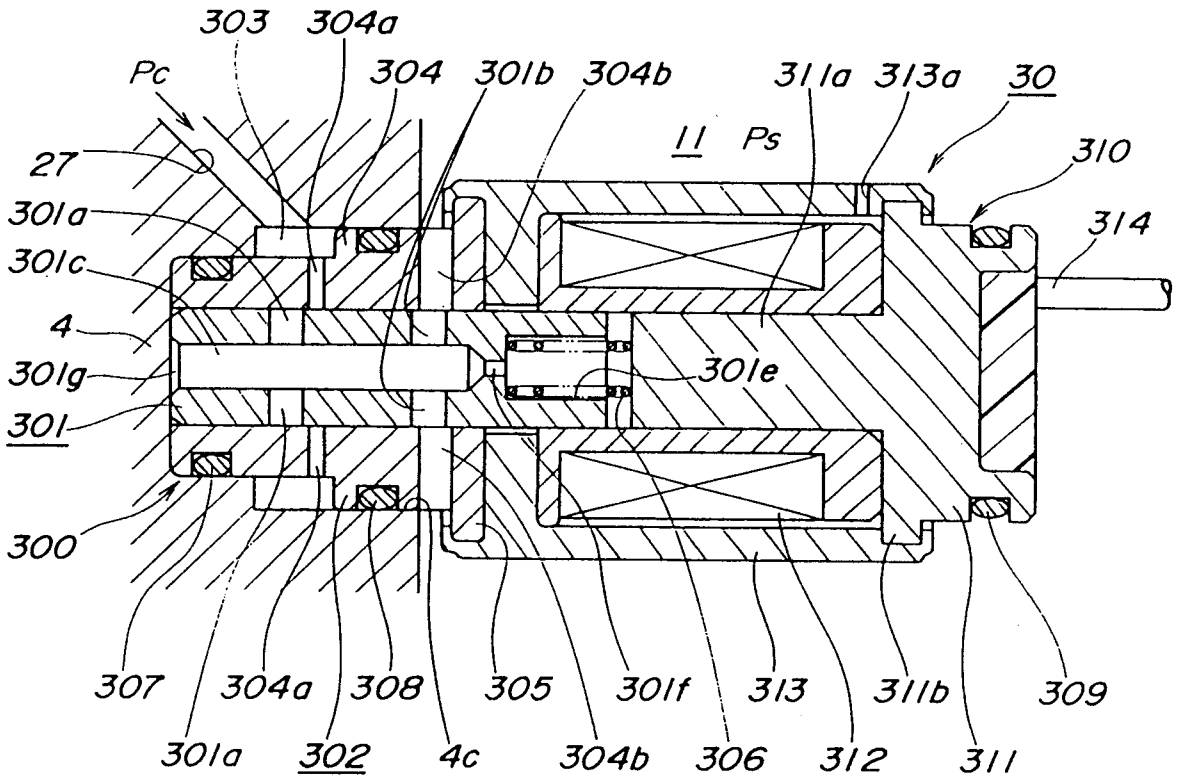
FIG. 2 is an enlarged sectional view of an electromagnetic spool valve in FIG. 1.

As shown in FIGS. 1 and 2, the control valve device 30 is formed by an electromagnetic spool valve, and comprises a spool valve 300 disposed to communicate between one of the high pressure chambers $23_2$, $23_2$ and the suction chamber 11, and an electromagnetic actuator 310 disposed to actuate the spool valve 300 by means of an electromagnetic force based on an external control signal from a control unit 29 shown in FIG. 5.

The spool valve 300 comprises a cylindrical valve casing 302 which is received in a valve-receiving bore 4*c* formed in the rear side block 4, and a spool 301 as a valve body slidably received within a spool-receiving bore formed through the valve casing 302. The valve casing 302 has a stepped cylindrical portion 304 fitted in the valve-receiving bore 4*c* and defining an annular space 303 between the portion 304 and the bore 4*c*, and a flanged portion 305 formed intergrally with one end of the member 302. The cylindrical portion 304 is formed therein with a pair of radial inlet ports 304*a*, 304*a* in communication with the annular space 303 at diametrically opposite locations, and a pair of radial outlet ports 304*b*, 304*b* adjacent the flanged portion 305 at diametrically opposite locations.

The spool 301 is formed therein with a pair of radial inlet passages 301*a* alignable with the respective corresponding inlet ports 304*a*, 304*a*, a pair of radial outlet ports 304*b*, 304*b* alignable with the respective corresponding outlet ports 301*b*, 301*b*, an axial internal passage 301*c* in communication with the inlet passages 301*a* and the outlet passages 301*b*, a spring-receiving axial bore 301*e* at an end thereof remote from the rear side block 4, and a communication hole 301*f* communicating between the axial internal passage 301*c* and the spring-receiving bore 301*e*. Sealing rings 307, 308 are fitted in the outer periperal surface of the cylindrical portion 304 to provide an airtight seal between the outer peripheral surface of the cylindrical member 304 and the inner peripheral surface of the valve-receiving bore 4*c*.

With such arrangement, when the spool 301 is in a valve closing position shown in FIG. 2, the inlet ports 304*a* of the cylindrical member 304 are closed by the outer peripheral surface of the spool 301. In this valve closing position, the outlet ports 304*b* are aligned with the outlet passages 301*b* of the spool 301. When the spool 301 is slightly moved from the position of FIG. 2 to a valve closing position, i.e. in the rightward direction as viewed in the same figure, the inlet ports 304*a* become aligned with the inlet passages 304*a* while the outlet ports 304*b* continue to communicate with the outlet passages 301*b*.

As noted above, the axial internal passage 301*c* is always in communication with the suction chamber 11 through the outlet ports 301*b*, 304*b* irrespective of the spool position. Further, the spool 301 has a small recess 301*g* formed in one end face thereof close to the rear side block 4, which is always in communication with the valve-receiving bore 301*e* at the opposite end through the axial internal passage 301*c* and the communication hole 301*f*. Consequently, the opposite end faces of the spool 301 are always acted upon by the suction pressure Ps so that the spool 301 is balanced in pressure.

Moreover, as shown in FIG. 2, the inlet ports 304*a* of the valve casing 302 and the inlet passage 301*a* of the spool are out of alignment with each other by a slight amount when the spool 301 is in the valve closing position. Consequently, even if the spool 301 is slightly displaced from the valve closing position toward the valve opening position, the inlet ports 304*a* and the inlet passages 301*a* can be brought into alignment with each other with a sufficient flow passage area to allow control pressure Pc to promptly leak from the high pressure chamber $23_2$ into the suction chamber 11. Therefore, the displacement of the spool 301 can be made smaller, and hence the electromagnetic force required for causing the displacement can be reduced. The electromagnetic force can be further reduced by increasing the number of the inlet ports 304*a* and the inlet passages 301*a*, i.e. the flow passage area.

On the other hand, the electromagnetic actuator 310 comprises a core 311 formed of a magnetic material and fitted in a mounting hole 6*b* formed in a lower portion of the rear head 6, a solenoid 312 wound around an axial projection 311*a* of the core 311, and a cover 313 formed of a magnetic material and disposed over the electromagnetic coil 312 with its opposite ends secured by caulking to the flanged portion 305 of the valve casing 302 and a flanged portion 311*b* of the core 311. An electric wire 314 is connected to the actuater 310 to supply the external control signal from the control unit 29 to the coil 312. The coiled spring 306 disposed in the spring-receiving bore 301*e* of the spool 301 has one end thereof abutting against an opposed end face of the axial projection 311*a* of the core 311, and urging the spool 301 in the valve closing direction. A sealing ring 309 is interposed between the outer peripheral surface of the core 311 and the hole 6*b* of the rear head 6 to provide an airtight seal therebetween.

The electromagnetic actuator 310 is energized by the external control signal supplied from the control unit 29 to generate an electromagnetic force to thereby cause the spool 301 to be displaced in the valve opening direction, as long as the control signal is at a high level. To cool the solenoid 312 of the actuator 310, a communication hole 313*a* is radially formed through an end portion of the cover 313 and communicates a gap defined between the outer peripheral surface of the solenoid 312 and the inner peripheral surface of the cover 313 with the suction chamber to introduce refrigerant gas from the latter into the former.

The control unit 29 operates based on parameter signals supplied thereto, such as an evaporator outlet temperature signal representative of a thermal load, an engine rotational speed signal, and an acceleration signal for minimizing the capacity of the compressor during acceleration of a vehicle on which the compressor is installed, to determine the pulse duty factor of an ON-OFF control signal as the external control signal and supply the signal to the electromagnetic spool valve 30 to thereby control the ratio between the valve opening period and valve closing period of the valve 30.

The operation of the variable capacity vane compressor constructed as above will be explained below.

The control unit 29 supplies the ON-OFF control signal as the external control signal to the solenoid 312 of the electromagnetic spool valve 30 for energizing and deenergizing the solenoid 312 based on the pulse duty factor determined from the parameter signals such as the thermal load signal. While the solenoid 312 is deenergized as long as the ON-OFF signal is at a low level, no electromagnetic force is generated so that the spool 301 is in the valve closing position as shown in FIGS. 2 and 5. In the valve closing position, the inlet ports 304*a* of the valve casing 304 are closed by the outer peripheral surface of the spool 301 to block the communication between the high pressure chambers $23_2$ and the suction chamber 11, whereby the control pressure Pc is increased within the high pressure chambers $23_2$. On the other hand, while the solenoid 312 is energized while the ON-OFF signal is at a high level, an electromagnetic force is generated to displace the spool 301 slightly rightward as viewed in FIG. 2 from the valve closing position into the valve opening position. In the valve opening position, the outlet passages 301*b* communicate with the outlet ports 304*b* while keeping the communication of the outlet passages 301*b* with the outlet ports 304*b* so that the high pressure chambers $23_2$ communicate with the suction chamber 11 via the communication passage 27, the annular space 303, the inlet ports 304*a*, the inlet passages 301*a*, the axial internal passage 301*c*, the outlet passages 301*b*, and the outlet ports 304*b* to leak the control pressure Pc from the high pressure chambers $23_2$ into the suction chamber 11, and thereby lower the control pressure Pc within the high pressure chambers $23_2$.

Thus, the control pressure Pc is increased while the ON-OFF signal level is low and decreased while it is high, respectively, so that the control pressure Pc assumes a value corresponding to the pulse duty factor, i.e. the ratio of the ON time period to the OFF time period of the ON-OFF signal.

Therefore, when the thermal load increases to increase the evaporator outlet temperature, the control unit 29 operates in response to the increased temperature to decrease the pulse duty factor of the ON-OFF control signal and hence increase the time period during which the spool 301 is in the valve closing position. Consequently, the control pressure Pc is increased so that the control element 24 is displaced toward the full capacity position as shown in FIG. 3 to thereby advance the compression starting timing, resulting in increased capacity or delivery quantity of the compressor.

Figure 4:
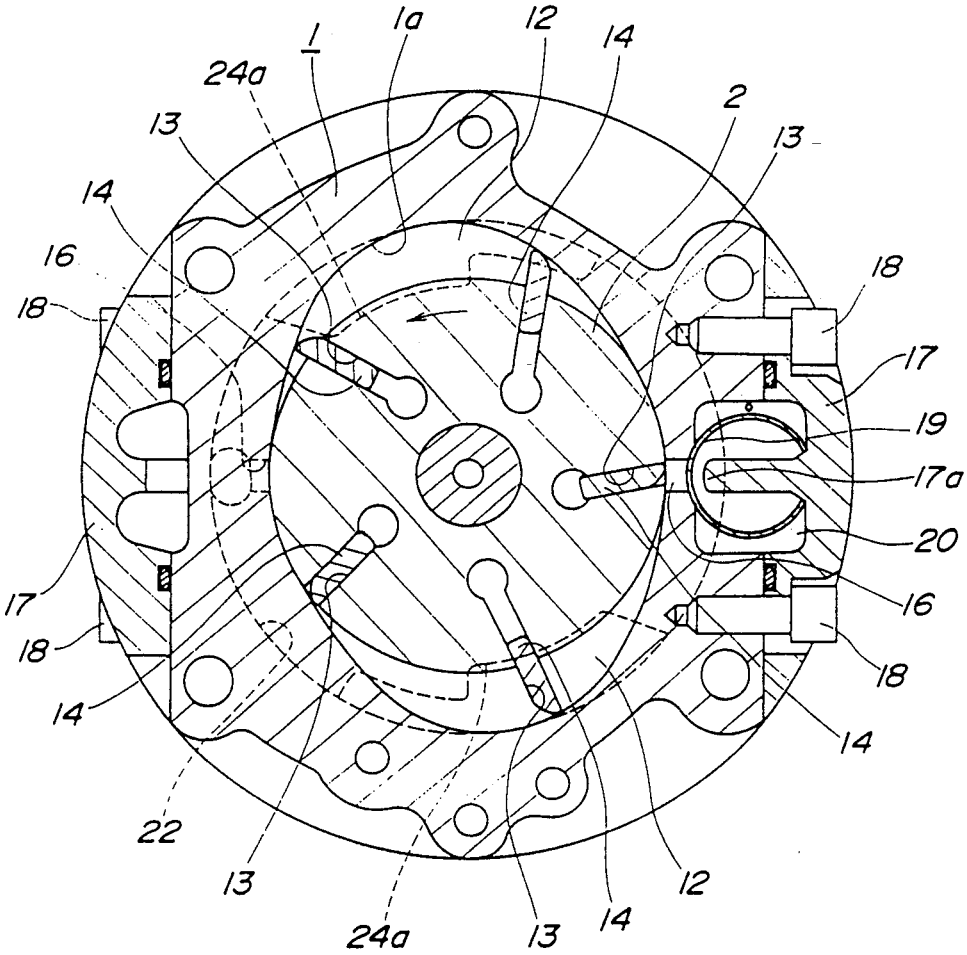
FIG. 4 is a view similar to FIG. 3, wherein the control element is in a partial capacity position.

Conversely, when the thermal load decreases to decrease the evaporator outlet temperature, the control unit 29 operates in response to the decreased temperature to increase the pulse duty factor of the ON-OFF control signal and hence decrease the time period during which the spool 301 is in the valve opening position. Consequently, the control pressure Pc is decreased so that the control element 24 is displaced toward the partial capacity position as shown in FIG. 4 to thereby retard the compression starting timing, resulting in decreased capacity of the compressor.

On the other hand, when the acceleration signal is inputted to the control unit 29 during acceleration of the vehicle, the control unit 29 increases to the maximum the pulse duty factor of the ON-OFF control signal and hence increase to the maximum the time period during which the spool 301 is in the valve opening position. Consequently, the control pressure Pc is decreased to the minimum so that the control element 24 is displaced into and held in the partial capacity position, resulting in the minimum capacity of the compressor and hence enhanced accelerability of the vehicle.

Further, as the engine rotational speed increases, the control unit 29 increases the pulse duty factor of the ON-OFF control signal so that the control element 24 is displaced toward the partial capacity position, resulting in decreased capacity of the compressor and hence prevention of excessive cooling of the vehicle compartment.

In the above described manner, the compressor capacity is electronically controlled by means of the external control signal.

Since, as mentioned before, the spool 301 has its opposite end faces both acted upon by the suction pressure Ps and is thus balanced in pressure, it can be smoothly displaced from the valve closing position into the valve opening position even by a small electromagnetic force of the actuator 310. Therefore, the compressor capacity can be controlled in a fine manner with high responsiveness without requiring the use of a large-sized electromagnetic valve and hence avoiding an increase in the compressor size.

What is claimed is:

1. In a variable capacity vane compressor having a cam ring, a pair of side blocks closing open opposite ends of said cam ring, a rotor rotatably received within said cam ring to define at least one compression space, a plurality of vanes radially slidably fitted in the vane slits of said rotor, a head fitted to an end face of one of said side blocks remote from said rotor to define a suction chamber, at least one inlet port formed in said one side block to communicate said suction chamber with said compression space, an annular recess formed in one end face of said one side block facing said rotor, a control element rotably received in said annular recess and having at least one pressure-receiving protuberance which defines at least one low pressure chamber disposed to be supplied with suction pressure from said suction chamber and at least one high pressure chamber for creating therein control pressure having a value higher than said suction pressure, communication passage means extending between said high pressure chamber and said suction chamber, and control valve means for opening and closing said communication passage means for varying said control pressure, wherein said control element rotates by the change of said control pressure to thereby vary compression starting timing in said compressor, resulting in varied capacity of said compressor, the improvement wherein said control valve means comprises:

a spool valve displaceable between a valve opening position for opening said communication passage means and a valve closing position for closing said communicating passage means;

an electromagnetic actuator disposed to generate an electromagnetic force to cause said spool valve to assume said valve opening position when energized; and control means arranged outside of said compressor for supplying said actuator with an external control signal for energizing same;

wherein said spool valve comprises a cylindrical valve casing having open opposite ends, said valve casing having inlet port means and outlet port means both formed therein and communicating with said high pressure chamber and said suction chamber, respectively, a spool slidably received within said valve casing for displacement in an air-tight manner between said valve opening position and said valve closing position, said spool having formed therein inlet passage means alignable with said inlet port means when it assumes said valve opening position, outlet passage means always aligned with said outlet port means irrespective of a position assumed by said spool, and internal passage means communicating between said inlet passage means and said outlet passage means, and spring means urging said spool toward said valve closing position; and said spool valve being disposed to open and close only said communication passage means while maintaining said outlet passage means always communicating with said outlet port means, said control signal is an ON-OFF signal, said spool valve being disposed to open and close said communication passage means at a rate corresponding to a pulse duty factor of said ON-OFF signal for varying said control pressure in accordance with the pressure in accordance with the pulse duty factor.

2. The compressor as claimed in claim 1, wherein said inlet port means of said valve casing and said inlet passage means of said spool are arranged such that they are out of alignment with each other by a slight amount when said spool is in said valve closing position.

3. The compressor as claimed in claim 1, wherein said internal passage means axially extends through said spool and opens in opposite end faces thereof, whereby said opposite end faces of said spool are acted upon by said suction pressure supplied from said suction chamber through said outlet port means, said outlet passage means, and said internal passage means.

4. The compressor as claimed in claim 2, wherein said internal passage means axially extends through said spool and opens in opposite end faces thereof, whereby said opposite end faces of said spool are acted upon by said suction pressure supplied from said suction chamber through said outlet port means, said outlet passage means, and said internal passage means.

5. The compressor as claimed in claim 1, wherein said inlet port means of said valve casing comprises a plurality of radial ports circumferentially arranged, said inlet passage means of said spool comprising a plurality of radial passages circumferentially arranged at circumferential locations corresponding respectively to said radial ports.

6. The compressor as claimed in claim 5, wherein said communication passage means has a valve-receiving bore at an end face of one of said side blocks remote from said rotor, said cylindrical valve casing being fitted in said valve-receiving bore in a manner such that an annular space is defined between an outer peripheral surface of said valve casing and said valve-receiving bore, said inlet port means of said valve casing opening into said annular space.

7. The compressor as claimed in claim 1, wherein said electromagnetic actuator comprises a core formed of a magnetic material and having an axial projection formed integrally therewith, a solenoid mounted on said axial projection of said core for receiving said external control signal, and a cover covering said solenoid, said cover having a communication hole formed therethrough and communicating between said suction chamber and an outer peripheral surface of said solenoid, whereby refrigerant is supplied from said suction chamber through said communication hole to said outer peripheral surface of said solenoid.

8. The compressor as claimed in claim 7, wherein said solenoid has a through hole formed therein, into which said axial projection of said core is inserted, one end of said spool being slidably fitted into said through hole in facing relation to said axial projection, said spring means comprising a torsion coiled spring interposed between said axial projection and said one end of said spool and urging said spool toward said valve closing position.

* * * * *